US005299680A

United States Patent [19]

Rhodes

[11] Patent Number: 5,299,680

[45] Date of Patent: Apr. 5, 1994

[54] CONVEYOR SYSTEM WITH TRANSVERSE PUSHER TO TRANSFER LOAD CARRYING UNITS BETWEEN SEPARATE CONVEYING PATHS

[76] Inventor: Arthur B. Rhodes, 4111 Waterford Cir., Apt. 7, Louisville, Ky. 40207

[21] Appl. No.: 987,464

[22] Filed: Dec. 4, 1992

[51] Int. Cl.[5] ..... B65G 17/32

[52] U.S. Cl. ..... 198/465.2; 104/88; 104/172.2

[58] Field of Search ..... 198/465.1, 465.2, 346.2, 198/803.01; 104/88, 130, 172.2

[56] References Cited

U.S. PATENT DOCUMENTS

| | | | |
|---|---|---|---|
| 2,894,460 | 7/1959 | Klamp | 104/88 |
| 2,965,043 | 12/1960 | Klamp | 104/88 |
| 3,146,874 | 9/1964 | McGow et al. | 198/38 |
| 3,174,439 | 3/1965 | Edgar et al. | 104/88 |
| 3,407,751 | 10/1968 | Orwin | 104/172 |
| 3,430,580 | 3/1969 | Edens | 104/28 |
| 3,742,860 | 7/1973 | Fahringer | 104/88 |
| 3,830,164 | 8/1974 | Biessener | 104/88 X |
| 4,371,075 | 2/1983 | Erlichman | 198/465.2 X |
| 4,406,230 | 9/1983 | Villemaud | 104/88 |
| 4,438,702 | 3/1984 | Rhodes | 104/172 |
| 4,638,740 | 1/1987 | Rhodes | 104/172.2 |
| 4,644,869 | 2/1987 | Rhodes | 104/172.2 |
| 4,770,285 | 9/1988 | Rhodes | 198/378 |
| 4,944,228 | 7/1990 | Rhodes | 104/172.2 X |
| 4,947,978 | 8/1990 | Rhodes | 198/465.1 X |
| 5,065,678 | 11/1991 | Rhodes . | |

*Primary Examiner*—James R. Bidwell
*Attorney, Agent, or Firm*—Charles G. Lamb

[57] ABSTRACT

A conveyor system having at least two conveyor tracks for moving load carrying units to different locations within a facility in which the conveyor system is installed, includes a device for selectively engaging and disengaging the load carrying units to and from the conveyor tracks, and a device for selectively pushing the load carrying units out of alignment with one of the conveyor tracks and into alignment with the other of the conveyor tracks.

6 Claims, 3 Drawing Sheets

CONVEYOR SYSTEM WITH TRANSVERSE PUSHER TO TRANSFER LOAD CARRYING UNITS BETWEEN SEPARATE CONVEYING PATHS

BACKGROUND OF THE INVENTION

The present invention relates to conveyor systems, and more particularly to a conveyor system having two continuously moving conveyors for moving load carrying units therealong with means for selectively moving load carrying units from one conveyor to the other without interfering with the operation of either of the conveyors.

Conveying systems are typically used in manufacturing facilities to move work pieces through work stations along a preselected path. There are a number of conveying systems for moving work pieces from work station to work station which include conveyors moving at a constant speed with load carrying units coupled for movement therewith between work stations and uncoupled from the conveyor so that they will be stationary at the work station while work is performed on a work piece carried by the load carrying units. Examples of patents directed to such conveying systems include U.S. Pat. No. 4,438,702; U.S. Pat. No. 4,644,869; U.S. Pat. No. 4,638,740; and, U.S. Pat. No. 4,770,285.

U.S. Pat. No. 5,065,678 is directed to a conveyor system with a transverse pusher device designed to transfer a load carrying unit from one separate conveying path to another conveying path. The transverse pusher device includes (1) means to raise and lower a conveyor tract engaging pin from engagement with a first conveyor tract and (2) means to push the load carrying unit from alignment with the first conveyor tract to alignment with a second conveyor tract while the engaging pin is in a raised position. However, the device for accomplishing this movement of a load carrying unit from a first conveyor tract to a second conveyor tract is directed to specifically designed load carrying units. These load carrying units have additional structure on the front end thereof for assisting in raising and lowering the engaging pin.

SUMMARY OF THE INVENTION

The present invention recognizes the problem in moving load carrying units from one moving conveyor to another moving conveyor without stopping either of the conveyors or in anyway interfere with the movement of other load carrying units being moved simultaneously on either conveyor.

In a preferred embodiment the present invention is directed to a conveyor system comprising: a first conveyor track defining a first conveyor path; a second conveyor track defining a second conveyor path; a portion of a length of said second conveyor track being in close proximity to a portion of a length of said first conveyor tract; at least one load carrying unit moveable with said first conveyor track and said second conveyor track, said load carrying unit including a vertically moveable track engaging pin; conveyor track load carrying unit transfer means including means to raise said engaging pin from engagement with one of said first or second conveyor tracks, means to push said pin from alignment with one of said first or second conveyor tracks to alignment with the other of said first or second conveyor tracks and means to lower said pin into contact with said other of said first or second conveyor track; and, means to activate and deactivate said transfer means.

BRIEF DESCRIPTION OF THE DRAWING

A better understanding of the invention will be had upon reference to the following description conjunction with the accompanying drawings, wherein like numerals refer to like parts throughout the several views and wherein.

DETAILED DESCRIPTION OF THE PREFERRED EMBODIMENT

Figure 1:
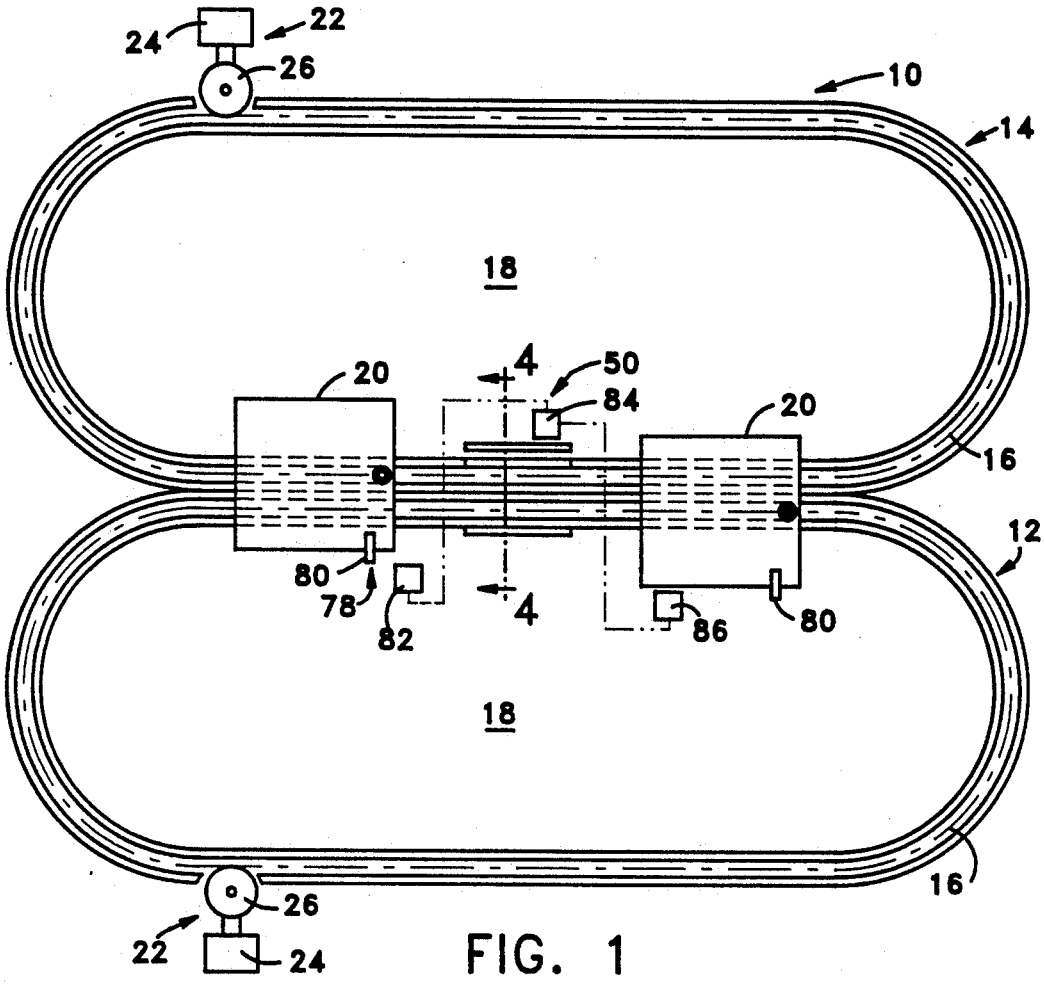
FIG. 1 is a plan view of a conveyor system of the present invention.

FIG. 1 schematically shows a conveyor system, generally denoted as the numeral 10, incorporating features of the present invention. The conveyor system 10 is shown as including two separate closed loop conveyor tracks such as a first conveyor track 12 and a second conveyor track 14 defining two separate conveying paths. The first and second conveyor tracks 12 and 14 are essentially identical, and each includes an endless chain 16 having interlocking chain links which move along the floor 18 of a facility.

Load carrying units 20 are coupled or engaged to the conveyor track 12 and track 14 for movement therewith. The conveyor system 10 further includes means 22 for moving each of the endless conveyor chains 16 of the track 12 and the track 14. Such a moving means 22 can include, for example, an electric motor 24 having a sprocket 26 attached to its output shaft with the sprocket 26 in meshing engagement with the endless chain 14 of the track 12 and the track 14. It should be clearly understood that while the conveyor track 12 and the track 14 are shown as being located on the floor of a facility, it is contemplated that the conveyor track 12 can also be located as an overhead conveyor track, or in the floor.

Figure 2:
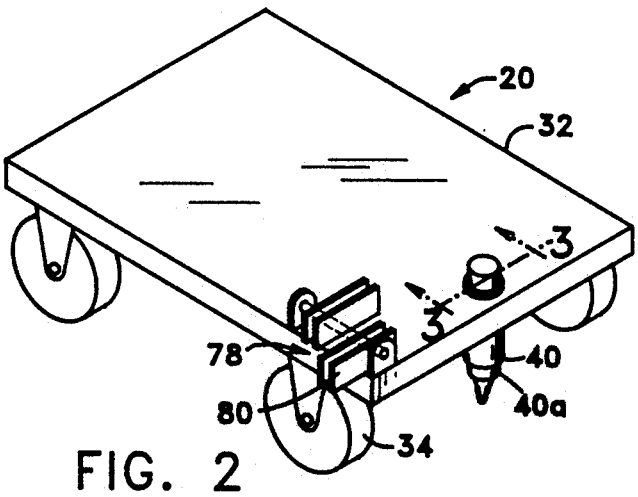
FIG. 2 is a perspective view of a load carrying unit movable with the conveyor system for carrying workpieces.

Now with reference to FIG. 2, there is shown a perspective view of one example of a load carrying unit 20 which can be used with the conveyor system 10. As shown, the load carrying unit 20 includes frame structure 32 and floor engaging wheels 34 rotatably attached to the frame structure 32. The frame structure 32 can be of virtually any construction and configuration to support a load to be carried and conveyed on the unit 20.

Figure 4:
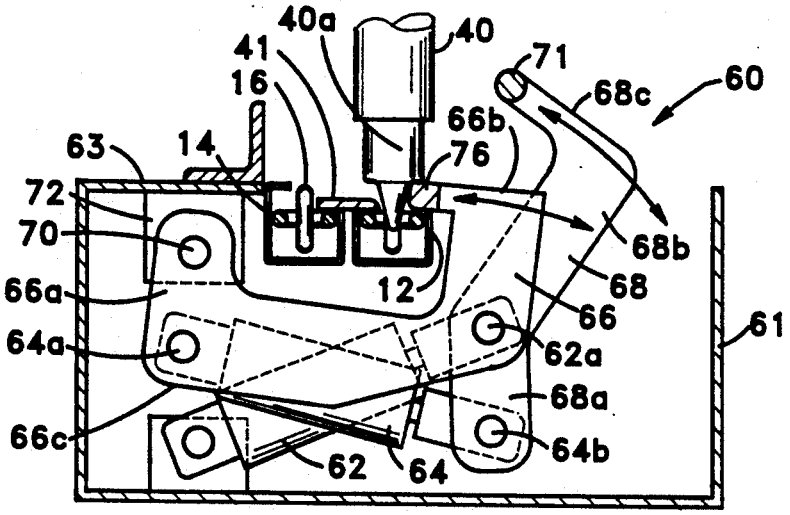
FIG. 4 is an enlarged cross-sectional view as seen in the direction of arrows 4—4 in FIG. 1 of one preferred load carrying unit transfer means of the present invention prior to transfer of a load carrying unit from a first conveyor system to a second conveyor system.
Figure 5:
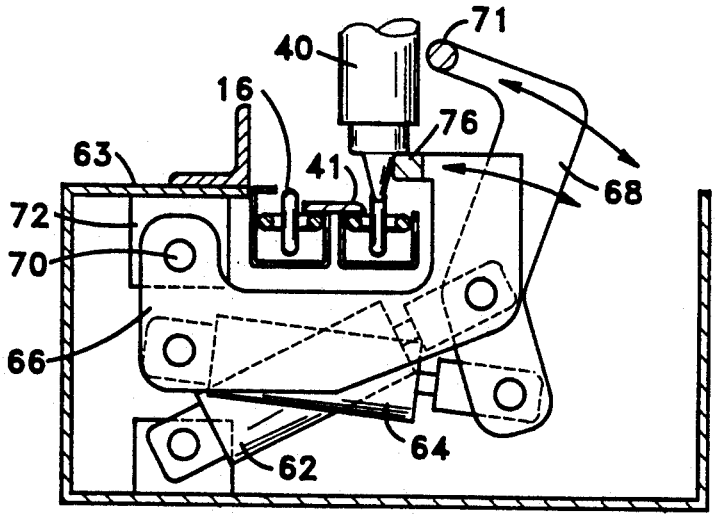
FIG. 5 is an enlarged cross-sectional view of the transfer means of FIG. 4 as the load carrying unit is being transferred from the first conveyor system to the second conveyor system.
Figure 6:
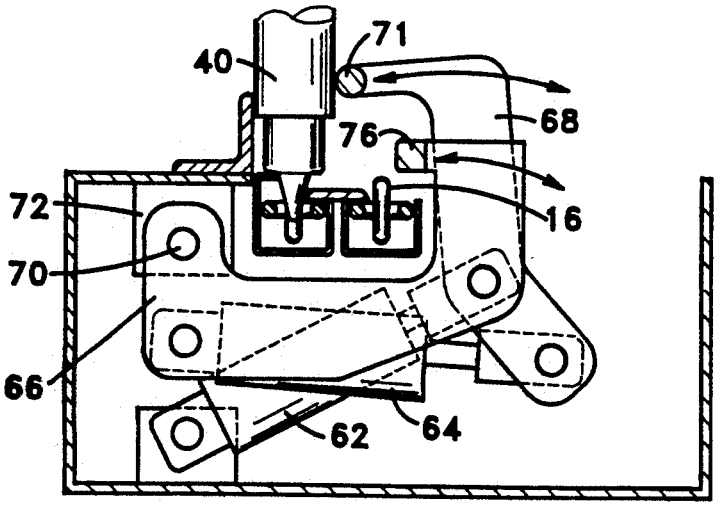
FIG. 6 is an enlarged cross-section view of the transfer means of FIG. 4 after the load carrying unit has been transferred from the first conveyor system to the second conveyor system.
Figure 7:
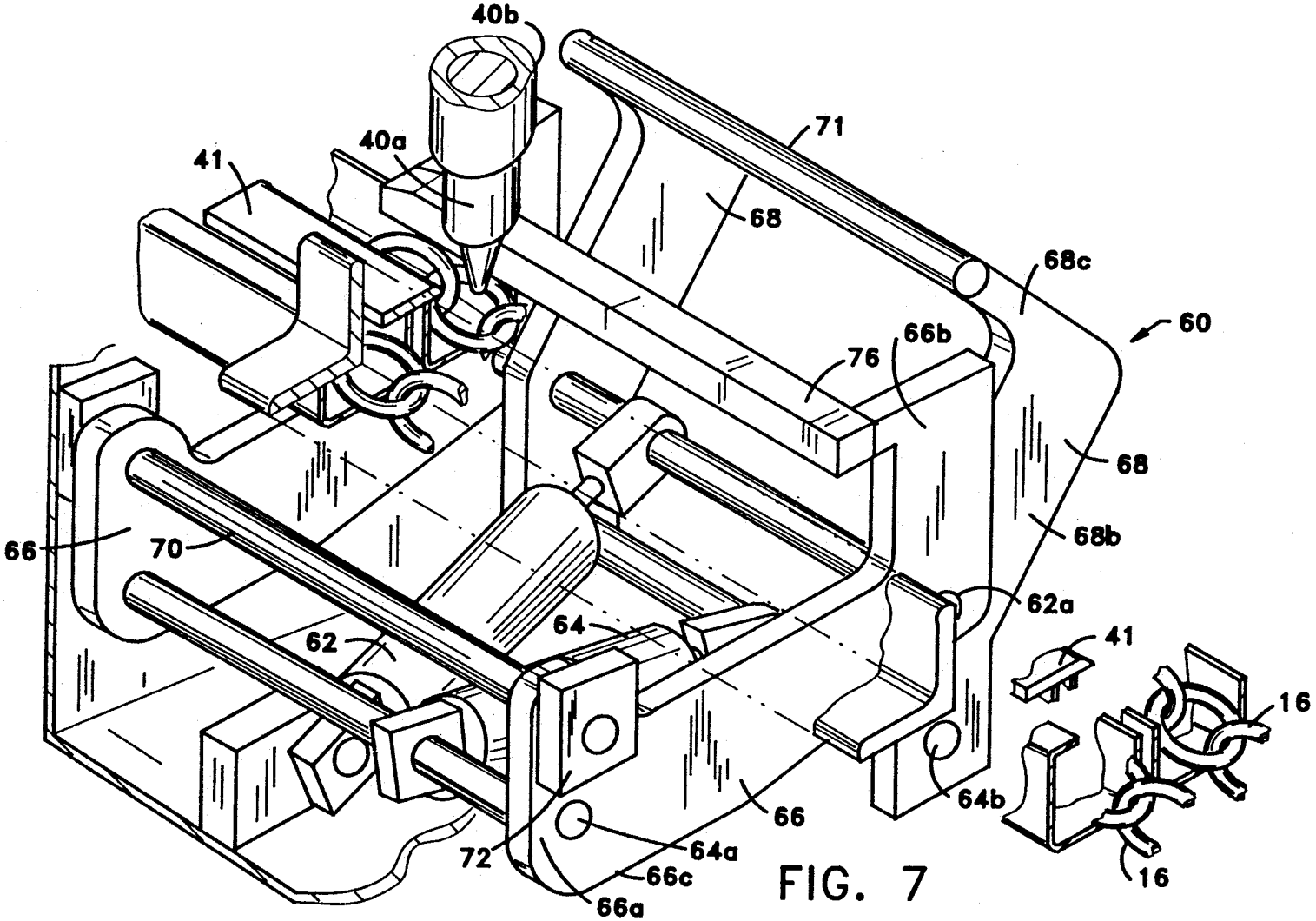
FIG. 7 is a perspective view, with selected portions cut-away, of the transfer means of FIGS. 4–6.

As shown, a conveyor chain engagement pin 40 assembly including a movable chain engaging pin 40a received within a stationarily mounted sleeve 40b is attached to the frame 32 near the front end of the unit 20. The movable chain engagement pin 40a is movable between a lowered, conveyor chain engaged position (shown in FIG. 4) and a raised, vertically displaced conveyor chain disengaged position (shown in FIG. 5). In the lowered, conveyor chain engagement position the depending end of the pin 40a is received in the opening of one of the horizontal links of the conveyor track chain 16, and in the raised conveyor chain disengaged position the depending end of the pin 40a is spaced a distance above and out of contact with the conveyor track chain 16 so that the conveyor track chain 16 moves beneath the depending end of the pin 40a. As can be best seen in FIG. 3, the pin 40a moves in a coaxial sleeve 40b which is attached to the frame structure 32 and depends in coaxial relationship with the pin 40a. The depending end of the sleeve 40b is spaced above the chain 16 of the conveyor tracks 12 and 14.

Figure 3:
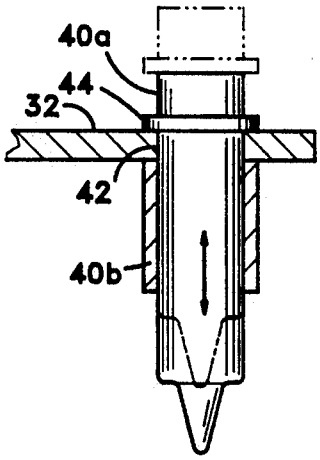
FIG. 3 is an enlarged cross-sectional view of one preferred vertically moveable engaging pin of the present invention with a raised position shown in phantom lines as seen in the direction of arrows 3—3 in FIG. 2.

Various constructions can be used to movably attach the movable pin 40a to the frame structure 32. As shown in FIG. 3, the movable pin 40a is axially, slidably received through a hole 42 in the frame 32 to depend vertically above the frame 32. A portion of the pin 40a also extends above the frame 32, and a keeper 44 is attached to the pin 40a proximate the upwardly extending end thereof. The conveyor engagement pin 40a is biased to the lowered conveyor chain engagement position by the force of gravity.

Now, with reference to FIGS. 4, 5, 6 and 7, the conveyor system 10 includes load carrying unit transfer means or station generally denoted as the numeral 50 for selectively transferring load carrying units 20 between conveyor tracks 12 and 14. The load transfer station 50 includes load carrying unit activating means, generally denoted as the numeral 82 and a load carrying unit transfer device generally denoted as the numeral 60. The activating means 82 is located in an area wherein the tracks 12 and 14 are adjacent to each other and functions to selectively activate the load carrying unit transfer device 60 to transfer the load carrying unit 20 from one conveyor track to the other conveyor track. The load carrying unit transfer device 60 includes a housing 61 which is of channel-shaped construction with a horizontally extending upper portion 63 which extends from one vertical side a preselected distance toward an opposed vertical side. The housing 61 is positioned in the floor facility and extends beneath the tracks 12 and 14 of the conveying system 10. Disposed within the housing 61 is a pair of air operated piston devices 62 and 64 which are mounted within the housing for moving a pair of parallel mounted generally U-shaped pin-raising members 66 and a pair of parallel mounted generally Z-shaped pusher members 68. Each U-shaped member 66 includes two opposed leg portions 66a and 66b, and a base portion 66c. The two U-shaped elements 66 are pivotally mounted to an elongated rod member 70 at the outer extremity of leg portions 66a to a bracket 72 which, in turn, is mounted onto the upper portion 63 of the housing 61. The leg portions 66b of U-shaped members 66 are attached to opposite ends of pin raising bar 76 which is engageable with the downwardly extending extremity of the engaging pin 40a. The downwardly extending portion of the pin 40a is tapered so that upon engaging with the pin raising bar 76, as the bar 76 moves toward the lower extremity of the pin 40a, pin 40a is lifted out of engagement with the endless chain 16, as discussed hereinafter. The U-shaped elements 66 are also pivotally attached at the juncture of leg 66b with base portion 66c to opposite ends of elongated rod member 62a. Rod member 62a, in turn, is rotatably mounted to the movable end of piston 62. At the juncture of leg portions 66a with base portions 66c, elements 66 are pivotably attached to opposite ends of elongated rod member 64a. Rod member 64a is, in turn, rotatably mounted to the stationary end of piston 64. Thus, movement of the U-shaped member 66 is in response to the movement of pistons 62 and 64.

The generally Z-shaped pusher member 68 includes a lower leg 68a, a base portion 68b, and an upper leg 68c. Lower leg 68a joins base portion 68b at an angle of about 45° and upper leg 68c joins base portion 68b at an angle of about −90°. The lower legs 68a of the parallel pusher members 68 are pivotally attached at their outward extremity to an elongated rod member 64b which, in turn, is also pivotally attached to the piston 64, but at its movable end. At the juncture of the lower legs 68a with the base portions 68b of the generally Z-shaped members 68, Z-shaped members 68 are also pivotally attached to the elongated rod member 62a. Thus, movement of the Z-shaped element 68 is also moveable in response to the operating action of the pistons 62 and 64.

As shown in FIGS. 1 and 2, each load carrying unit 20 includes limit switch engagement means, generally denoted as the numeral 78 for activating various limits of the load carrying unit transfer station 50. As shown, the limit switch engagement means comprises a flag 80 attached to the top side of the load carrying unit frame carrying structure 32. The flag 80 is pivotally attached at one of its ends to the load carrying unit frame structure 32 so that it can selectively be pivotated between an inoperative position or an operative position wherein it projects beyond the side edge of the load carrying unit 20. Limit switch 82 is positioned upstream of the transfer station 50 and is situated adjacent to the tracks 12, 14 in location whereat the flag 80 is engageable with switch 82 as it moves past. Limit switch 82 is in electrical communication with a computer 84 which is in turn in operative communication with the pistons 62 and 64. A second limit switch 86 is situated adjacent to the tracks 12, 14 downstream of the transfer station 50. The limit switch 86 is positioned for engagement with flag 80 as the load carrying unit 20 moves past. Limit switch 86 is also in electrical communication with computer 84.

In operation, a load carrying unit 20 moving with the conveyor chain 16 of the track 12 moves past the first limit switch 82 and the limit switch engagement means flag 80 contacts the first limit switch 82 which then provides information to the computer 84 advising that the limit switch 82 has been engaged. The computer 84, which may be programmed for a time delay if the limit switch 82 is of a preselected distance upstream from the transfer station 50 or the computer 84, is in operative communication with the pistons 62 and 64 and activates the pistons 62 and 64 whereby the pin raising bar 76 engages the pin 40a raising the pin 40a out of engagement with the moving endless chain in track 12. Generally, piston 62 is actuated a preselected time, usually less than a second, before actuating of piston 64. Thus, the pin 40a is raised from the endless chain in track 12 prior to the upper leg portion 68c of the Z-shaped member 68 engaging with the sleeve 40b thereby pushing the pin 40a into alignment with the endless conveyor chain 16 in the track 14. Upon alignment with the chain 16 in track 14, the pistons 62 and 64 are de-activated and return to their normal position and gravity pulls the pin 40a downwardly into engagement with one of the lengths of the chain as it moves there-past. Upon engagement with the chain 16 in track 14, the load carrying unit 20 then moves on downstream.

The foregoing description is given primarily for clearness of understanding and no unnecessary limitations are to be understood therefrom for modifications will become obvious to those skilled in the art upon reading this disclosure and may be made without departing from the spirit of invention or scope of the appended claims.

What is claimed is:

1. A conveyor system comprising:

a first conveyor track defining a first conveyor path;

a second conveyor track defining a second conveyor path;

a portion of a length of said second conveyor track being in close proximity to a portion of a length of said first conveyor track;

at least one load carrying unit moveable with said first conveyor track and said second conveyor track, said load carrying unit including a vertically moveable track engaging pin;

conveyor track load carrying unit transfer means including means to raise said engaging pin from engagement with one of said first or second conveyor track, means to push said pin from alignment with one of said first or second conveyor tracks to alignment with the other of said first or second conveyor tracks, and means to lower said pin into contact with said other of said first or second conveyor track, said means to push said pin includes a piston having a pin pushing member in cooperating relationship therewith, said pin pushing member including an outwardly extending member adapted to engage a downwardly extending sleeve attached to said load carrying unit, said pin movable within said sleeve, said piston and said means to push said pin being positioned so that in a first position said pin pushing member engages said sleeve and in a second position pushes said sleeve including said pin and said load carrying unit a preselected distance; and means to activate and deactivate said transfer means.

2. The conveyor system of claim 1, said means to raise said engaging pin and said means to lower said engaging pin includes a piston having a pin engaging member in cooperating relationship with said piston, said pin engaging member including an outwardly extending portion adapted to engage said pin, said piston and pin engaging member being positioned so that in a first position said engaging portion engages said pin and in a second position, said engaging portion raises said pin.

3. A conveyor system comprising:

a first conveyor track defining a first conveyor path;

a second conveyor track defining a second conveyor path;

a portion of a length of said second conveyor track being in close proximity to a portion of a length of said first conveyor track;

at least one load carrying unit moveable with said first conveyor track and said second conveyor track, said load carrying unit including a vertically moveable track engaging pin;

conveyor track load carrying unit transfer means including means to raise said engaging pin from engagement with one of said first or second conveyor track, means to push said pin from alignment with one of said first or second conveyor tracks to alignment with the other of said first or second conveyor tracks, and means to lower said pin into contact with said other of said first or second conveyor track, said conveyor track load carrying transfer means includes a pair of pistons in cooperating relationship with said means to raise said engaging pin and means to push said pin, said pair of pistons includes a first piston in cooperating relationship with a pin pushing member and second piston in cooperating relation with a pin raising member and said pin pushing member, said pin raising member is of U-shaped configuration and said pin pushing member is of Z-shaped configuration, said U-shaped member having opposed first and second legs with a base portion therebetween and said Z-shaped member having opposed first and second legs with a base portion therebetween;

at the juncture of the first leg and the base portion of said U-shaped member, said U-shaped member is pivotally attached at one end of said first piston, at the juncture of said second leg with said base portion of said U-shaped member, said U-shaped member is pivotally attached to one end of said second piston;

said Z-shaped pin pushing member is pivotally attached at the juncture of said base portion and said lower leg portion to said one end of said second piston and the end extremity of said lower leg portion of said Z-shaped member being attached to an opposite end of said one end of said first piston; and, means to activate and deactivate said transfer means.

4. The conveyor system of claim 3, wherein said second piston is actuated a preselected time before said first piston.

5. The conveyor system of claim 4, wherein the U-shaped member includes a pair of U-shaped members in spaced parallel relationship and the Z-shaped member includes two Z-shaped members in spaced parallel relationship.

6. The conveyor system of claim 4 wherein the U-shaped member includes a pusher bar at the upper extremity of the second leg, said spacer bar connecting said upper extremities of said second leg of said U-shaped member.

* * * * *